US006343454B1

(12) United States Patent
Fisher

(10) Patent No.: US 6,343,454 B1
(45) Date of Patent: Feb. 5, 2002

(54) METHOD OF FURNITURE ASSEMBLY CAPABLE OF SECURING AND VERTICALLY ADJUSTING AND ALIGNING EDGE MOLDINGS AND TRIM TO A SURFACE

(76) Inventor: Frederick D. Fisher, 2475 Interstate Cir., Pensacola, FL (US) 32526

( * ) Notice: Subject to any disclaimer, the term of this patent is extended or adjusted under 35 U.S.C. 154(b) by 0 days.

(21) Appl. No.: 09/199,221

(22) Filed: Nov. 24, 1998

(51) Int. Cl.[7] ..... A47B 13/08

(52) U.S. Cl. ..... 52/782.2; 52/716.1; 52/782.22; 52/796.11; 52/800.12; 312/140.4; 108/27; 156/182; 156/293

(58) Field of Search ..... 52/716.1, 716.2, 52/716.3, 782.2, 782.21, 782.22, 782.23, 783.1, 783.19, 796.11, 796.12, 796.14, 800.12, 312; 248/345.1; 312/140.1, 140.3, 140.4; 108/27; 156/182, 293

(56) References Cited

U.S. PATENT DOCUMENTS

| | | | | | |
|---|---|---|---|---|---|
| 2,228,504 | A | * | 1/1941 | Braun | 52/782.23 |
| 3,055,722 | A | * | 9/1962 | Chase et al. | 108/27 |
| 3,352,080 | A | * | 11/1967 | Rondum | 52/796.11 X |
| 3,582,170 | A | * | 6/1971 | Schaeffer | 312/140.4 |
| 4,333,288 | A | * | 6/1982 | Coombs | 52/312 |
| 4,958,888 | A | * | 9/1990 | Livnah | 312/140.3 |
| 4,996,817 | A | * | 3/1991 | Nelson | 52/716.1 X |
| 5,157,891 | A | * | 10/1992 | Nelson | 52/716.1 X |
| 5,310,435 | A | * | 5/1994 | Kelly | 52/796.12 X |
| 5,469,685 | A | * | 11/1995 | Nelson | 52/716.1 X |
| 5,470,140 | A | * | 11/1995 | Schagunn | 312/140.3 |
| 5,569,505 | A | * | 10/1996 | Nichols | 52/782.22 X |
| 5,613,342 | A | * | 3/1997 | Nelson | 52/716.1 X |
| 5,809,901 | A | * | 9/1998 | Gutzmer | 312/140.3 X |
| 6,012,787 | A | * | 1/2000 | Jennings et al. | 312/140.3 |

OTHER PUBLICATIONS

Fine Homebuilding, "Making Bevel–Edge Laminate Countertop" by Herrick Kimball, p. 88–93, Mar. 1998.*

* cited by examiner

*Primary Examiner*—Winnie S. Yip

(57) ABSTRACT

A fast, easy method of attaching and properly adjusting furniture edging that facilitates the improved aesthetic quality of the finished product while also providing an attachment that is both strong and watertight. The countertop assembly defines a edge construction having a unique double tongue and groove configuration that wedgably interlocks a decorative side molding against the exposed edge of a furniture panel by means of a specially configured groove on the bottom side of the furniture panel. This method of edge construction instantly locks and tightens the edge molding against the furniture panel edge thus, eliminating the need for temporary clamping while at the same time allowing for critical vertical adjustment of the edge molding to ensure the proper alignment of the top of the edge molding with the furniture panel. The invention is particularly adaptable for use in the construction of countertops or other furniture parts where a finished surface material such as plastic laminate is bonded to a support decking such as particle board.

10 Claims, 7 Drawing Sheets

METHOD OF FURNITURE ASSEMBLY CAPABLE OF SECURING AND VERTICALLY ADJUSTING AND ALIGNING EDGE MOLDINGS AND TRIM TO A SURFACE

TECHNICAL FIELD

The present invention relates to furniture construction. In particular, the invention pertains to the construction and attachment of decorative and/or wear-resistant edges on countertops and the like.

BACKGROUND ART

In furniture construction, countertops, desktops, shelves, dividers and other similar components most often consist of a support decking hereinafter referred to as a core material to which a finished top surface is applied. The finished top surface may be a plastic laminate, varnished veneer or other decorative material. Thus, while this core/finished surface component results in a durable, aesthetically pleasing plane surface, it leaves the edge of the core material exposed and, because the core material (e.g., particle board or plywood) is selected for its structural rather than aesthetic qualities, its exposed edge is most often considered unsatisfactory for the finished product either because of the visible surface it presents or its vulnerability to damage. Thus, it is common practice to apply a decorative edging that meets the finished surface of the countertop component and hides the edge of the core material.

In some countertop designs, the decorative edging may simply consist of coating the edge of the core material with some type of paint. In other countertop designs, the decorative edging may consist of a strip of relatively thin material, similar to the finished countertop surface material, that is glued over the edge of core material to hide it. Using this method, the decorative edging is most often applied to the core material edge prior to the application of the countertop surface itself. After application of the countertop surface material, it is then routed and/or filed flush with the decorative edging.

In still other countertop designs, the edging is a decorative molding that constitutes a separate component with a decorative side, a substrate or molding component core and, a joining side. The joining side is the side which is in direct contact with the exposed core edge of the countertop component. The decorative molding component is applied to the exposed core edge of the countertop component using for example glue, splines and/or wire brads to hold the joining side of the decorative edge molding component tightly against the exposed edge of the countertop component core material thus leaving only the finished surface of the countertop component and the decorative side of the decorative molding component exposed. At the same time, in addition to being held tightly together, the top edge of the decorative molding component is intended to align with the finished surface of the countertop component.

This latter countertop edging methodology, while it offers great decorative potential, presents some difficult assembly problems that tend to limit its usage. Initially, the difficulty arises from the need to properly bond the decorative molding to the countertop edge in a way that ensures a tight, strong connection without ruining the aesthetic appearance of the molding or the countertop. This often requires extensive simultaneous clamping over the length of a long countertop. The clamping is often complicated, tedious and awkward not only because of its length but also because of the close proximity of finished cabinetwork below and the limited open time of the adhesive. The application is even further complicated by the need to maintain the precise alignment of the top edge of the decorative edge molding with the countertop surface at all points along the entire length of the countertop until the adhesive dries.

One proposal for improved attachment of this type edging is described and illustrated in U.S. Pat. Nos. 5,613,342, 5,469,685, 5,157,891 and 4,996,817, all of which are issued to Nelson, entitled "FURNITURE EDGE CONSTRUCTION." The Nelson invention provides for a generally longitudinal channel, horizontally disposed, formed in a front exposed edge of the countertop core material and a decorative edging piece having a protruding rib on its joining side which is received within the milled channel.

In *Fine Homebuilding*, March 1998, No. 114, at Pages 88–93, an article entitled "MAKING BEVEL-EDGE LAMINATE COUNTERTOPS," by Herrick Kimball, (copy attached), further describes the application of plastic laminate clad bevel edge molding to a countertop. The molding described in the article can be either flat-backed or tongue-backed. The tongue-backed molding is similar in structure to the molding described by Nelson. The article illustrates the precision work required to align and then clamp (while maintaining alignment) the molding to the countertop during assembly. The tongued molding when compared to the flat-backed molding may, in some cases, either minimally assist or further complicate correction of the problems as described below. In fact, these problems are characteristic of all currently available methods of attachment. The *Fine Homebuilding* article referenced above shows the need to sand the top edge of the decorative edge molding at the seam where it meets the countertop surface to correct any misalignment in places where the edging is higher than the countertop surface. Such sanding or filing, although common, is highly undesirable and must be very limited because it quickly results in a dark line where the substrate of the plastic laminate is exposed. Such exposure defeats one of the main aesthetic features of this type of edging. Although not addressed in the article, this same critical seam (where countertop surface and the top edge of the edge molding meet) could be misaligned in the other direction, wherein the top of the edge molding is lower than the countertop surface. This problem would not be correctable by filing or sanding but would also result in a highly undesirable black line and potential damage because the front edge of the countertop surface material would be exposed. Finally, if not properly clamped over the entire length of the countertop, this same critical seam could be open wherein the top edge of the edge molding is not held tightly against the countertop surface. These latter two problems could only be corrected by reclamping and applying more pressure in the desired directions wherever needed along the countertop length. This reclamping can only be done on the assumption that the glue is not too hard so as to preclude necessary movement without damage. Left uncorrected, any of these problems or a combination thereof will result in an inferior, if not unsatisfactory, product.

It should also be recognized that the alignment and clamping problems discussed above with respect to plastic laminate clad edge moldings are equally applicable to other decorative edge moldings such as finished wood or solid polymer.

Other references in the countertop art are U.S. Pat. No. 5,569,505, issued to Nichols, entitled "DECORATIVE PANEL CONSTRUCTION"; U.S. Pat. No. 4,958,888, issued to Livnah, entitled "LOW STRESS CONCENTRATION CUTOUT COUNTERTOP"; and, U.S. Pat. No.

4,333,288, issued to Combs, entitled "BEVEL EDGE TRIM," none of which meet the needs of the present invention.

*Cabinetmaker Magazine*, July 1998, pages 18–19, in an article entitled "Custom Needs Drive Cabinet Designs" by Ann Marie Moss and Joe Stella, reports on the results of its 10th Annual Kitchen Trends Survey. The survey showed that wood and solid surface trimmed countertops was an up and coming trend for 1998. The growing popularity of all forms of decorative edge moldings for countertops, shelving and the like demands the continued efforts of the furniture industry to increase the efficiency of decorative molding attachment methods.

SUMMARY OF THE INVENTION

The present invention is substantially different in structure and approach from known edge molding attachment methodologies and results in a higher, more consistent quality finished product by providing a simple solution to all of the misalignment and clamping problems described above. In addition, the present invention significantly expedites fabrication and results in a very strong, watertight interconnection between components. The invention is adaptable to the construction of countertops, shelving or other edged furniture components that use any of the common surfacing materials (e.g., plastic laminate, veneer or solid polymer) applied over a support decking.

The method of the present invention involves 1) cutting a groove with an angled face on the underside of the countertop component core material opposite the finished surface and near and, parallel to, the exposed countertop component core edge to which the decorative molding is to be applied. This groove in turn creates a downwardly facing wedge-shaped tongue between its front angled face and the exposed core edge.

The second step of the method involves 2) applying the decorative side of the decorative edge molding component which is to be applied to the countertop component. The decorative side can be any of a very wide variety of configurations and finishes as desired by the designer, fabricator or customer as long as its top edge presents a straight, clean line for abutment to the front edge of the countertop component.

An object of the present invention is to provide a joining side of the molding component which has a generally "J" shape defined by a flat back joining surface that extends down from the top edge of the decorative molding for a distance that is slightly greater than the total thickness of the countertop component exposed edge. An "L" configuration then extends rearward from the lowest point on the flat back joining surface and then upward thereby creating a tongue that extends upward with its faces parallel to the flat back joining surface. At the same time, a groove is created between the front face of the upward facing tongue and the face of the flat back joining surface of the molding component. This groove is open at the top. In the preferred embodiment, the upward facing tongue extends upward slightly less than half the height of the flat back surface of the decorative molding.

The method further includes, 3) glueing, preferably with a water soluble glue with a reasonable open time, say 30 minutes or more. Glue is applied in a thin even coat over the flat back joining surface of the molding component and over the exposed core edge of the countertop component. A small bead of glue is also applied into the bottom of the upward facing groove of the molding component and on the top edge of the upward facing tongue of the molding component. The method further includes 4) mating the molding component and the countertop component by bringing the molding component up vertically from below the countertop component such that the flat back joining surface of the molding component is parallel to and in planar alignment with the exposed core edge of the countertop component. As the molding component is raised vertically, the upward facing tongue of the molding component fits into the specially configured groove in the bottom of the core material of the countertop component and the downward facing tongue at the front edge of the countertop component core material fits into the groove between the flat back surface of the molding component and the upward facing tongue of the molding component. The upward and downward facing tongues thus mate with the downward and upward facing grooves. The angled front face of the groove in the bottom of the countertop core serves as a ramp which wedgeably forces the upward facing tongue of the molding component away from the exposed core edge of the countertop component which in turn draws the flat back joining surface of the molding component tighter and tighter against the core edge of the countertop component as the molding component continues to be raised until the top decorative edge of the molding component is flush with the finished surface of the countertop component and the component pieces are firmly wedged together. While the clamping action of the wedged joint is significant, it should be recognized that until the glue sets, the molding component can still be adjusted vertically in order to ensure proper alignment with the countertop component finished surface. In addition, because of the strength of the clamping action, it is possible to adjust the alignment of the molding component at various points without disturbing the alignment at other points.

In view of the above objects, it is a feature of the present invention to provide a countertop assembly which is easy to install.

It is another feature of the present invention to provide a countertop assembly which is relatively simple structurally and thus simple to manufacture.

A significant advantage of the present invention is the ability to vertically adjust and align the entire longitudinal length of the top edge of the molding component with the top surface of the countertop component to create a flush alignment therebetween during the gluing phase of the countertop assembly installation.

A further advantage of the present invention is the tight connection which eliminates the need for clamping.

A further advantage of the present invention is the ability to vertically adjust and align the entire longitudinal length of the top edge of the molding component with the top surface of the countertop component to compensate for any manufacturing misalignments or offsets which would otherwise compromise the desired flush alignment between the top edge of the molding component and the top surface of the countertop component.

The above and other objects, features and advantages of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
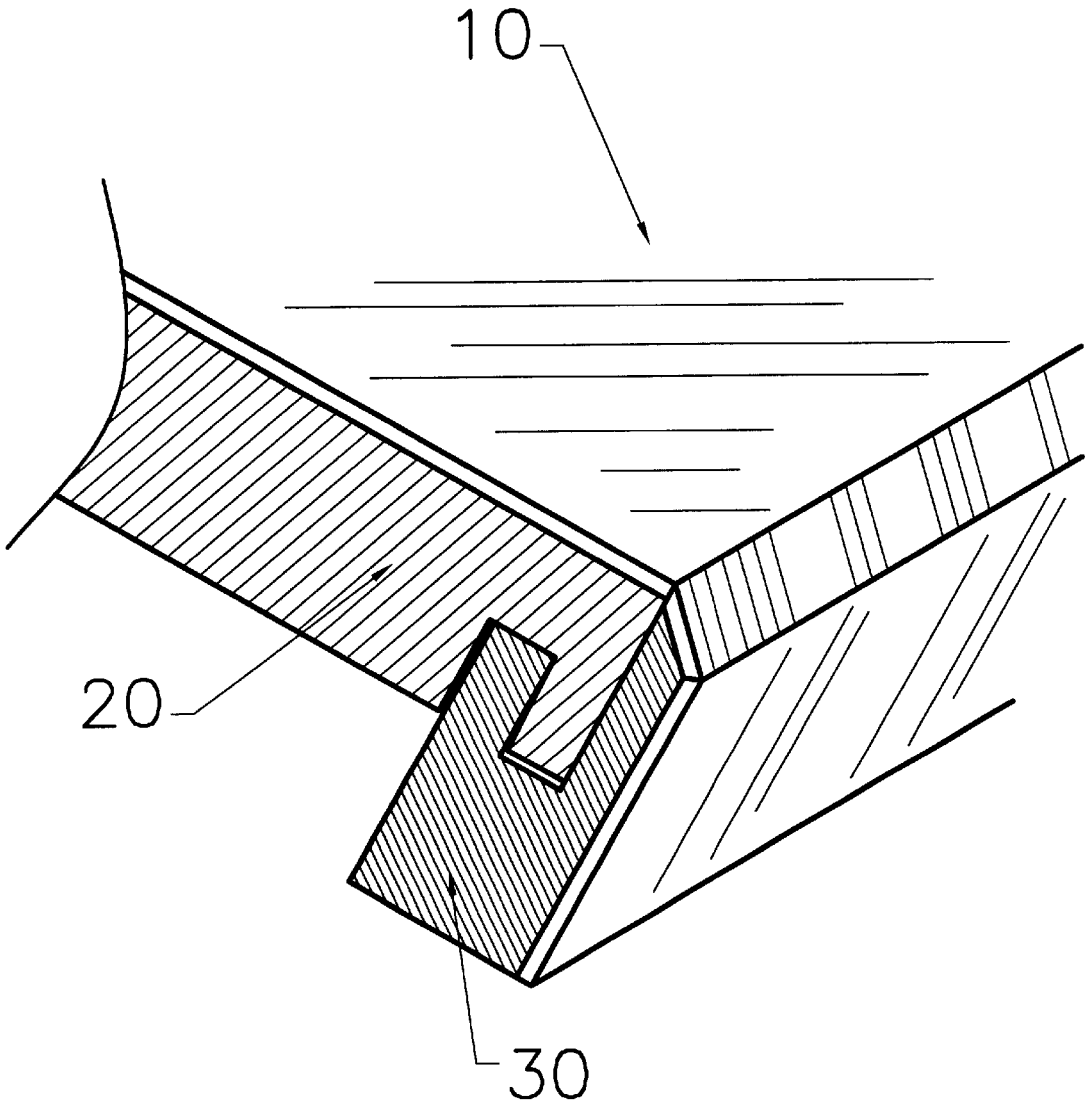
FIG. 1 is a perspective sectional view of a countertop assembly configured in accordance with the first embodiment of the present invention.

Referring now to the drawings, FIG. 1, shows the overall countertop assembly of the present invention which is designated by the numeral 10. The countertop assembly 10 is comprised of a countertop component 20 and a molding component 30.

Figure 2:
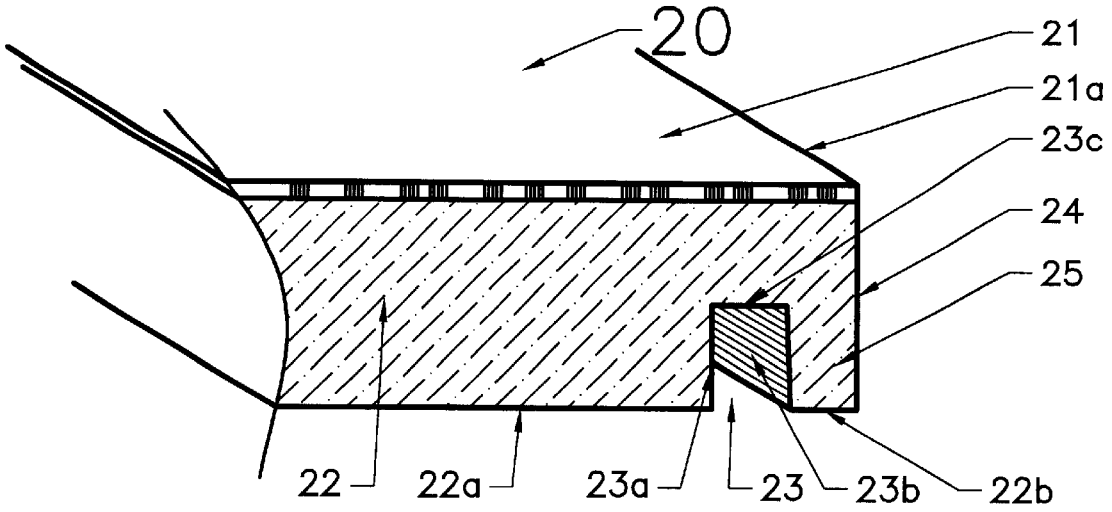
FIG. 2 is a perspective sectional view of a countertop component configured in accordance with the first embodiment of the present invention and ready for assembly.
Figure 3:
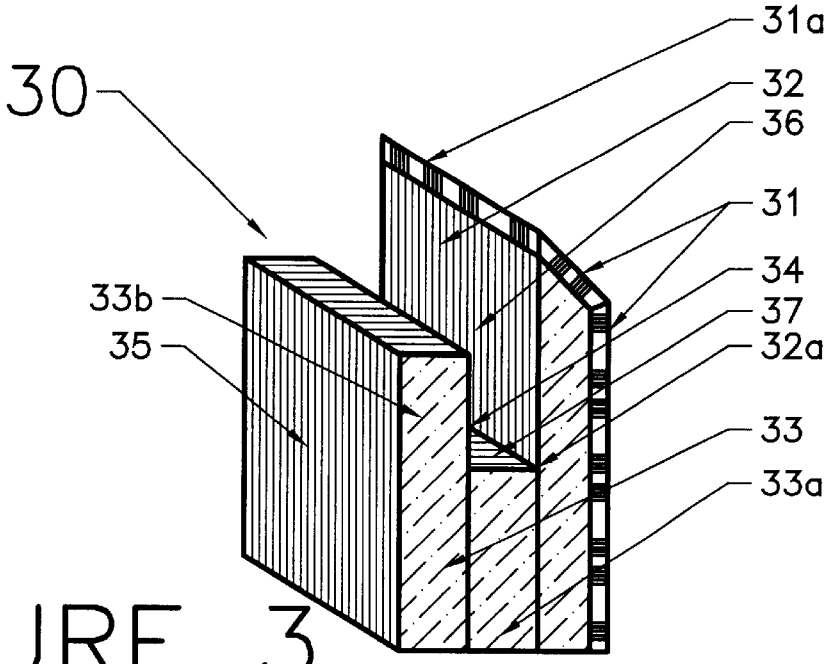
FIG. 3 is a perspective sectional view of a molding component configured in accordance with the first embodiment of the present invention.

Referring to FIG. 2, the countertop component 20 includes a finished surfacing material 21, such as plastic laminate, which is bonded to a core material 22, such as particle board or plywood. The core material 22 has a groove 23 cut in its bottom surface 22*a* which is opposite the surface to which the finished surfacing material 21 is bonded. The groove 23 runs parallel to the exposed core sidewall 24 which is to be covered by the decorative molding component 30 (FIG. 3).

FIG. 2 shows a cross section view of groove 23. In the first embodiment of the present invention, rear wall 23*a* of groove 23 is perpendicular to the bottom surface 22*a* of core material 22. The front wall 23*b* of groove 23 is not perpendicular to the bottom surface 22*a* of core material 22 rather it is angled slightly so that groove front wall 23*b* is closer to the exposed core material sidewall 24 at the mouth of groove 23 than it is at the root of groove 23 where front wall 23*b* meets groove roof wall 23*c*.

As can be seen from FIG. 2, creation of groove 23 in turn creates a downward facing tongue 25 whose front side is the surface of the exposed core material sidewall 24 and whose rear side is the angled front wall 23*b* of groove 23 and whose tongue end 22*b* is the remainder of bottom surface 22*a* of core material 22 that lies between groove 23 and the exposed core material side wall 24 after groove 23 has been cut.

Figure 4:
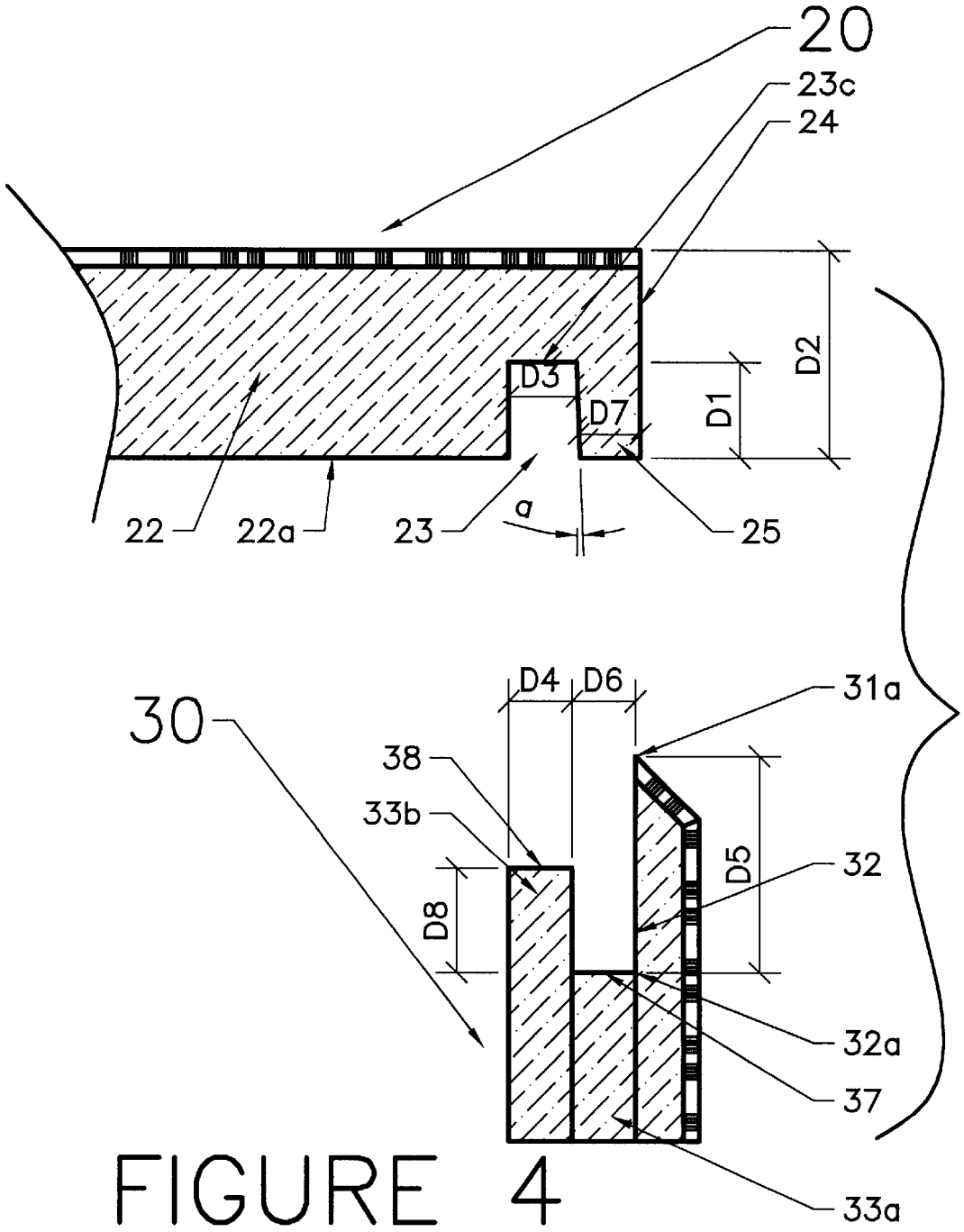
FIG. 4 is an exploded illustration of a side view of the countertop and molding components of the countertop assembly showing dimensional relationships for the first embodiment of the present invention.

Referring to FIG. 4, in the preferred embodiment angle a would be 4 degrees +/−1 degree from perpendicular with the bottom surface 22*a* of the countertop component core 22 and the depth D1 of groove 23 is slightly greater than one half the total exposed sidewall thickness D2 of the countertop component 20. The width D3 of groove roof wall 23*c*, is substantially equal to the width D4 of the upward facing tongue 33*b* on the molding component 30.

Referring to FIG. 3, the molding component 30 consists of a decorative front side 31. There are many shapes for the decorative front side of countertop moldings. For example some may be square or beveled on the top with a flat face, or the decorative front side might be a full half round. Similarly, the finish surface material (e.g., plastic laminate, varnish, solid polymer) of the decorative front side 31 of molding component 30 varies. It should be recognized that neither the shape of the decorative front side nor the material used for the finished surface are subjects of the present invention. What is important is that the top edge 31*a* of molding component 30 where the finished side 31 meets the flat back joining face 32 is straight and well defined and is intended to align with, and fit tightly against the front edge 21*a* (FIG. 2) of finished surface 21 of countertop component 20 when the molding component 30 and the countertop component 20 are assembled. Referring again to FIG. 3, the core 33 of molding component 30 although shown as 3 pieces for clarity and definition, may, in fact, be milled from a single piece of material such as medium density fiberboard, solid wood, solid polymer or it may be built up from several pieces of material of adequate size and strength. The joining side of the molding component 30 is a "J" shape consisting of a flat back joining surface 32 that extends down from the top edge 31*a* of the decorative molding component 30 for a distance that is slightly greater than the total thickness of the countertop component exposed sidewall. As FIG. 3 shows, a spacer piece 33*a* then extends rearward from the lowest point 32*a* on the flat back joining surface and serves to hold an upward facing tongue 33*b* away from the flat back joining surface 32 with its faces 34 and 35 parallel to the flat back joining surface 32. At the same time, spacer piece 33*a* creates a groove 36 above its upper face 37 and between the front face 34 of the upward facing tongue 33*b* and the face of the flat back joining surface 32 of the molding component 30. As can be seen, this groove is open at the top. In the preferred embodiment, the upward facing tongue extends upward slightly less than half the height of the flat back joining surface 32.

Referring to FIG. 4, the height D5 of the flat back joining surface 32 of molding component 30 as measured from the uppermost finished edge 31*a* to the intersection 32*a* of the flat back joining surface a and the upper surface 37 of spacer portion 33*a* is slightly greater than the total exposed sidewall thickness D2 of the countertop component 20. The width D6 of spacer portion 33*a* (and of upward facing groove 36 which it creates) is substantially equal to the midpoint thickness D7 of the downward facing tongue 25 on countertop component 20. The spacer portion 33*a* of molding component 30 is rectangular and serves to hold upward facing tongue 33*b* away from and parallel to flat back joining surface face 32 of the molding component 30. In the first embodiment of the present invention, the width D4 of the top edge 38 of upward facing tongue 33*b* is substantially equal to the width D3 of the groove roof wall 23*c* on the countertop component 20. The effective height D8 of upward facing tongue 33*b* is slightly less than one half D2 which is the exposed sidewall thickness of the countertop component 20

Figure 5:
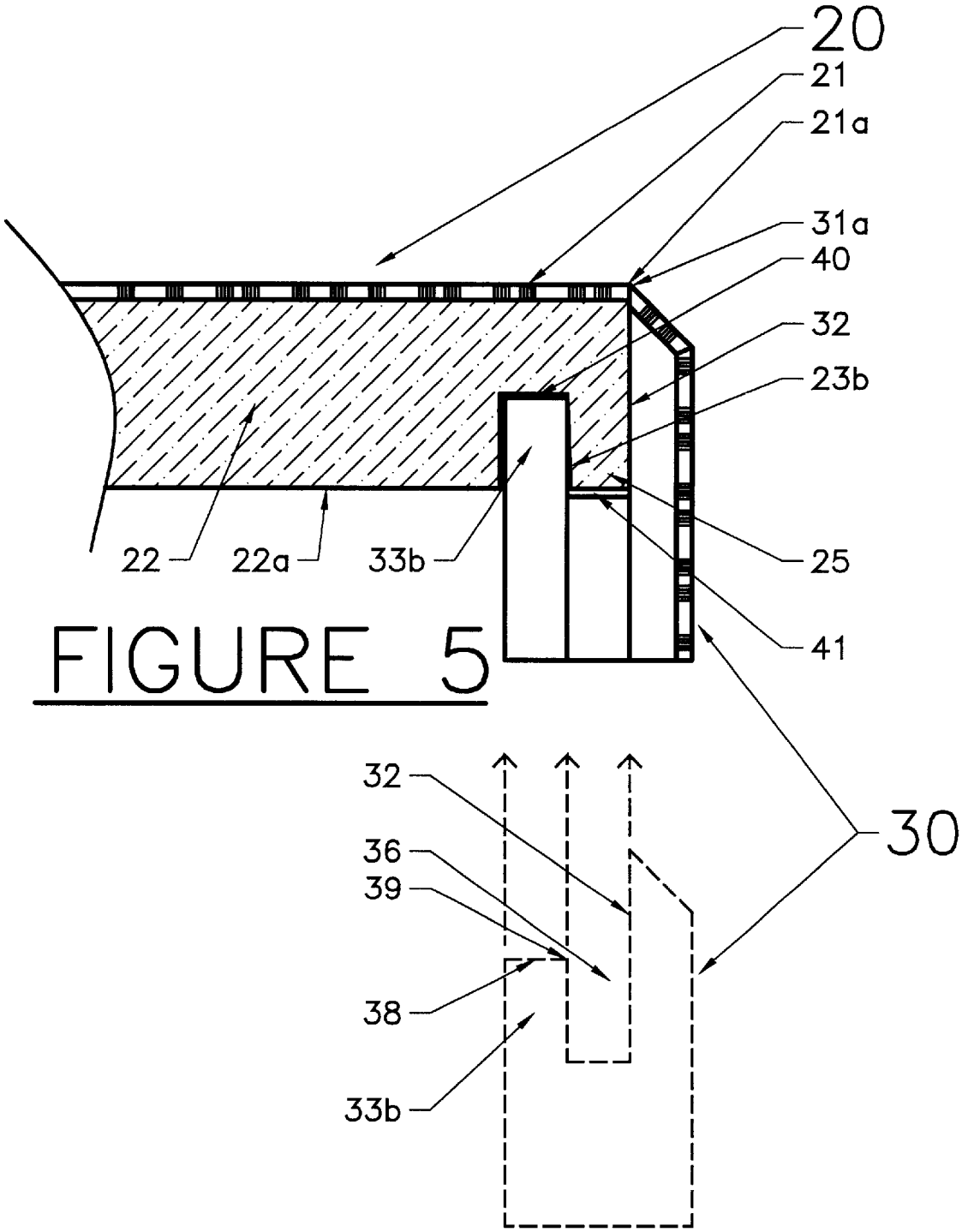
FIG. 5 is a partial side view of an assembled countertop assembly configured in accordance with the first embodiment of the present invention.

FIG. 5 shows an assembled countertop configured in accordance with the first embodiment of the present invention. Construction of a countertop component 20 in accordance with the present invention involves cutting a groove in the bottom 22*a* of the countertop core material 22 as described in reference to FIGS. 2 and 4 above. The molding component 30 is configured as described in reference to FIGS. 3 and 4 above. When ready for assembly, a thin coat of glue with a reasonable open time, say 30 minutes, is applied to the exposed countertop core edge 24 of countertop component 20 and to the flat back joining surface 32 of the molding component 30. A bead of glue is then run in the bottom of upward facing groove 36 of molding component 30 and on the top edge 38 of the upward facing tongue 33*b* of molding component 30. After application of glue, molding component 30 is placed below countertop component 20 so that the flat back joining surface 32 of the molding component 30 is parallel to and in planar alignment with the exposed countertop core edge 24 of countertop component 20. The molding component is then raised vertically until the upward facing tongue 33*b* of molding component 30 enters the downward facing groove in the countertop component 20 and the downward facing tongue 25 of countertop component 20 enters the upward facing groove 36 in the molding component 30. As molding component 30 is raised further, the uppermost forward edge 39 of upward facing tongue 33*b* of molding component 30 contacts the rear angled face 23*b* of downward facing tongue 25 of countertop component 20. Once contact is made, further raising of the molding component 30 wedgeably forces upward facing tongue 33*b* back away from exposed countertop core edge 24 which in turn forces the flat joining surface 32 of molding component 30 tighter and tighter against the countertop core edge 24 of countertop component 20. By the time the top edge 31*a* of decorative molding component 30 is aligned with the front edge 21*a* of the finished surface 21 of countertop component 20, the molding component 30 and the countertop component 20 are firmly and tightly wedged together. Despite the tightness of this clamping action, as long as the glue is wet, the molding component 30 can still be adjusted vertically up or down to ensure proper alignment of top edges 31*a* and 21*a* at all points along the countertop assembly. The beads of glue applied in groove 36 and to tongue edge 38 are forcibly distributed as countertop component 20 and molding component 30 are assembled thereby-filling voids 40 and 41 with glue.

Figure 6:
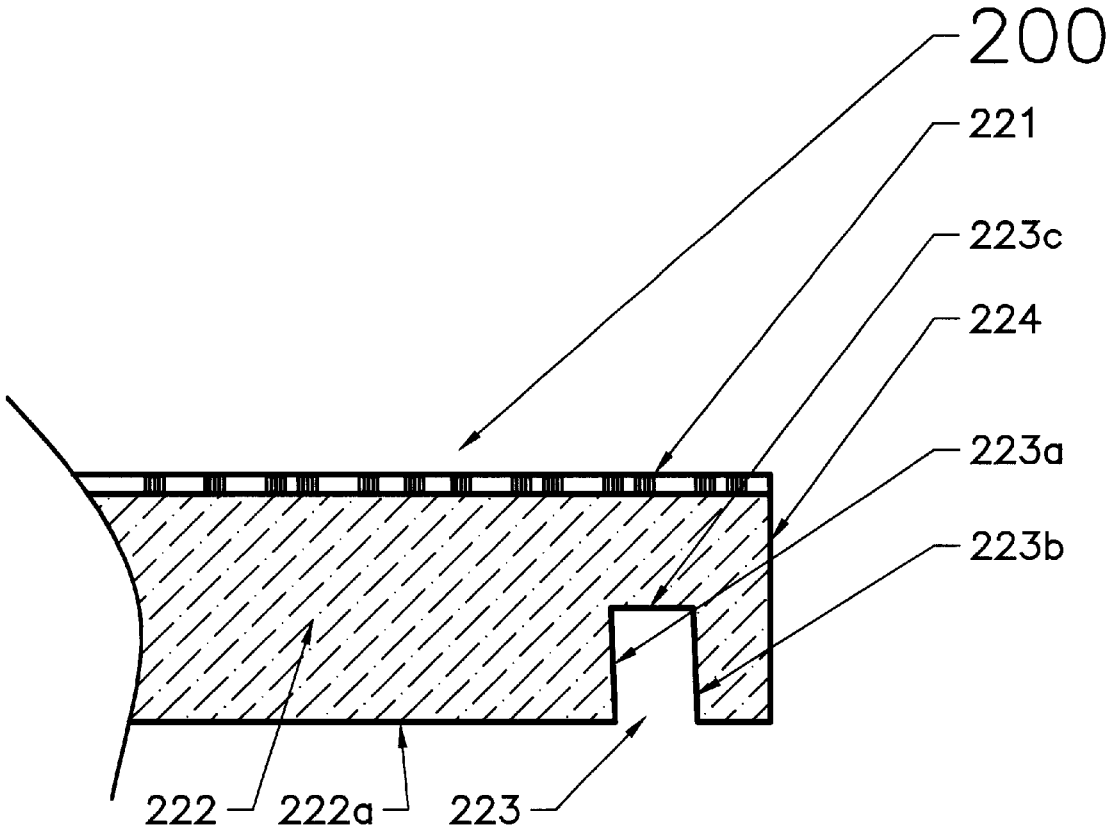
FIG. 6 is a partial side view of a countertop component configured in accordance with the second embodiment of the present invention.

FIG. 6 shows a countertop component 200 configured in accordance with the second embodiment of the present invention wherein the groove in the bottom surface of the countertop component is cut using a straight router bit, slot cutter or other cutting tool that produces an angled groove whose walls are parallel to one another. In the second embodiment of the present invention, the countertop component 200 consists of a finished surfacing material 221 such as plastic laminate which is bonded to a core material 222 such as particle board or plywood. The core material 222 has a groove 223 cut in its bottom surface 222*a* which is opposite the surface to which the finished surfacing material 221 is bonded. The groove 223 runs parallel to the exposed core material sidewall 224 which is to be covered by the decorative molding 300 (FIG. 7).

As can be seen in FIG. 6, in the second embodiment of the present invention, rear wall 223*a* of groove 223 is parallel to the front wall 223*b* of groove 223. Neither the rear wall 223*a* nor the front wall 223*b* of groove 223 are perpendicular to the bottom surface 222*a* of core material 222 rather both are angled slightly so that front wall 223*b* and rear wall 223*a* are both closer to the exposed core material sidewall 224 at the mouth of groove 223 than they are at the root of groove 223 where front wall 223*b* and rear wall 223*a* meet groove roof wall 223*c*.

In the second embodiment of the present invention only the countertop component differs as described above, the molding component 300 (FIGS. 7 and 8) is identical to the molding component 30 in the first embodiment as described in reference to FIGS. 3 and 4 above.

Figure 7:
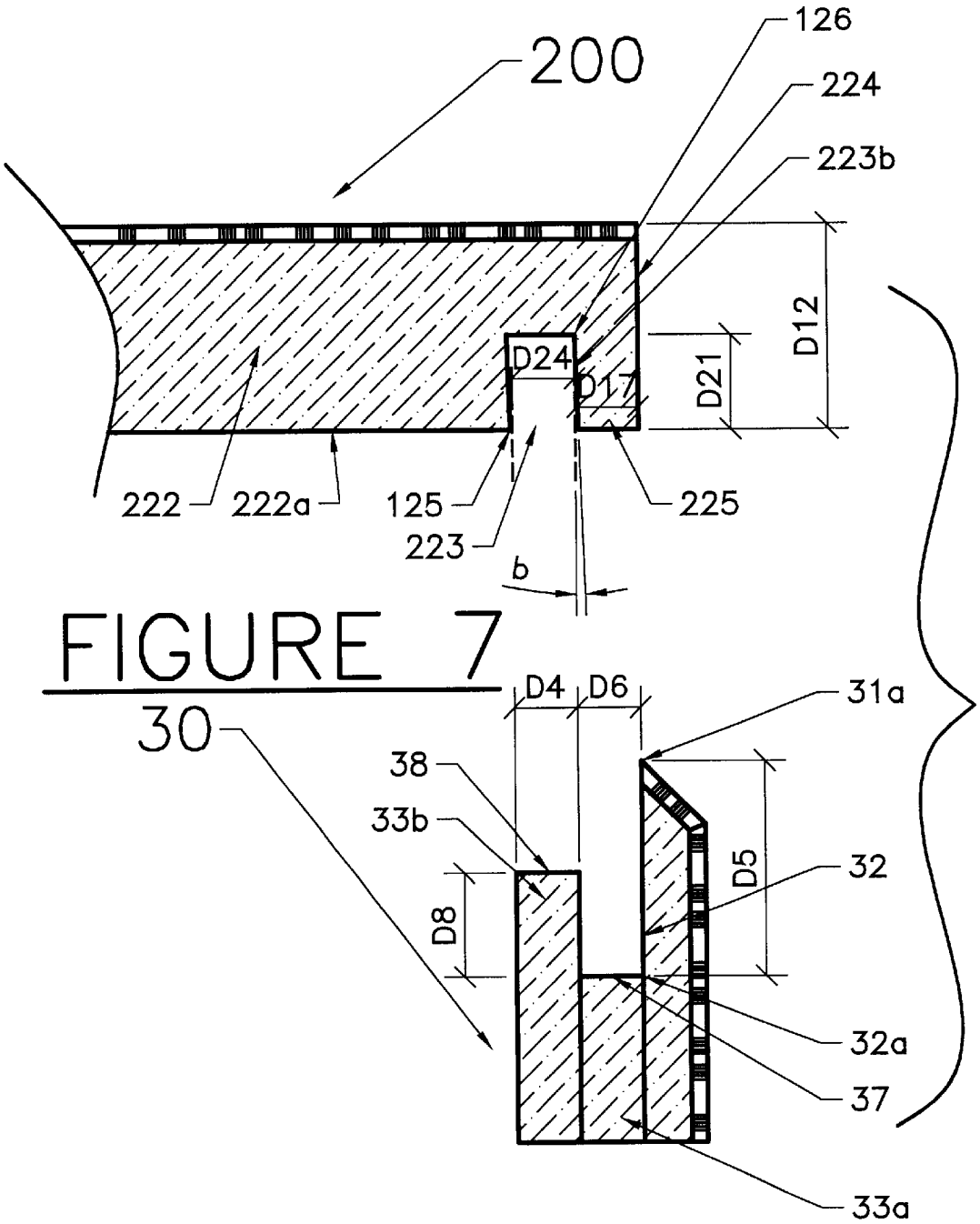
FIG. 7 is an exploded illustration of a sectional side view of the countertop and molding components showing dimensional relationships for the second embodiment of the present invention; and, FIG. 8 is an end sectional view of an assembled countertop configured in accordance with the second embodiment of the present invention.

FIG. 7 presents the preferred dimensional relationships for the second embodiment of the present invention. In the preferred embodiment, angle b would be 4 degrees from perpendicular +/−1 degree. Front wall 223*b* and rear wall 223*a* of groove 223 are parallel to each other. The height D5 of the flat back joining surface face 32 of molding component 300 as measured from the uppermost finished edge 31*a* to the intersection 32*a* of the flat back joining surface face and the upper surface 37 of spacer portion 33*a* is slightly greater than the total exposed sidewall thickness D12 of the countertop component 200. The width D6 of spacer portion 33*a* is substantially equal to the midpoint thickness D17 of the downward facing tongue 225 on countertop component 200. The spacer portion 33*a* of molding component 300 is rectangular and serves to hold upward facing tongue 33*b* away from and parallel to flat back joining surface face 32 of the molding component 300. In the second embodiment of the present invention, the width D4 of the upward facing tongue 33*b* of molding component 300 is substantially equal to D24 which is the shortest distance between 2 parallel lines that are perpendicular to bottom surface 222*a* of countertop component 200 and where one of the lines passes through point 125 which is the rear edge of the mouth of groove 223 and the other passes through point 126 which is the deepest point of groove 223. The effective height D8 of upward facing tongue 33*b* is slightly less than one half D12 which is the overall exposed sidewall thickness of the countertop component 200. The effective depth D21 of groove 223 as measured to its deepest point 126 is slightly greater than one half of D12 which is the overall exposed sidewall thickness of countertop component 200.

Figure 8:
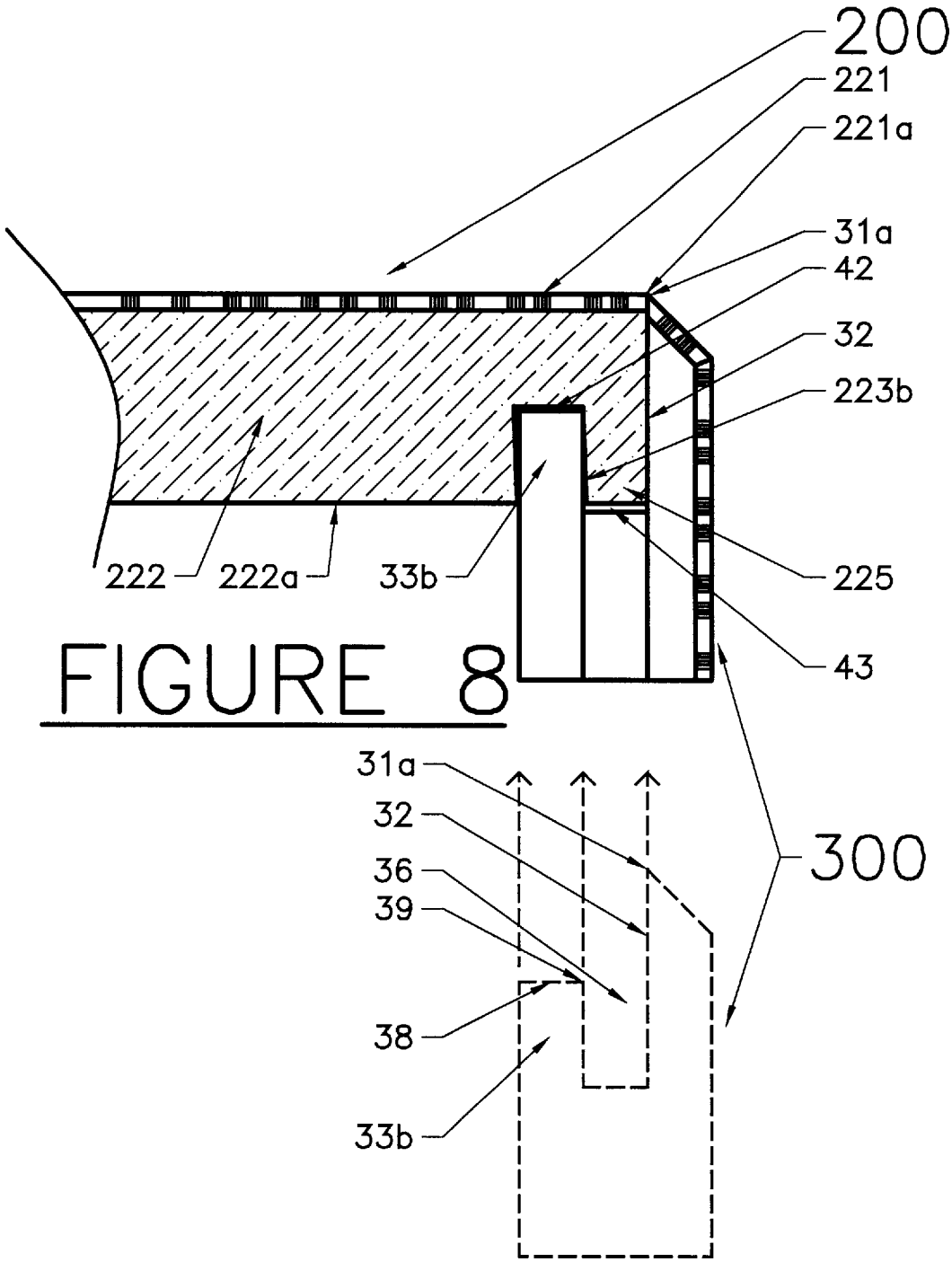

FIG. 8 shows an assembled countertop configured in accordance with the second embodiment of the present invention. In the second embodiment, construction of a countertop assembly in accordance with the present invention involves cutting a groove in the bottom surface 222*a* of the countertop core material 222 of countertop component 200 as described in reference to FIGS. 6 and 7 above. The molding component 300 is identical to molding component 30 and is configured as described in reference to FIGS. 3 and 7 above. When ready for assembly, a thin coat of glue with a reasonable open time, say 30 minutes, is applied to the exposed countertop core edge 224 of countertop component 200 and to the flat back joining surface 32 of the molding component 300. A bead of glue is then run in the bottom of upward facing groove 36 of molding component 300 and on the top edge 38 of the upward facing tongue 33*b* of molding component 300. After application of glue, molding component 300 is placed below countertop component 200 so that the flat back joining surface 32 of the molding component 300 is parallel to and in planar alignment with the exposed countertop core edge 224 of countertop component 200. The molding component 300 is then raised vertically until the upward facing tongue 33*b* of molding component 300 enters the downward facing groove in the countertop component 200 and the downward facing tongue 225 of countertop component 200 enters the upward facing groove 36 in the molding component 300. As molding component 300 is raised further, the uppermost forward edge 39 of upward facing tongue 33*b* of molding component 300 contacts the rear angled face 223*b* of downward facing tongue 225 of countertop component 200. Once contact is made, further raising of the molding component 300 wedgeably forces upward facing tongue 33*b* back away from the countertop core edge 224 which in turn forces the flat joining surface 32 of molding component 300 tighter and tighter against the countertop core edge 224 of countertop component 200. By the time the top edge 31*a* of decorative smolding component 300 is aligned with the front edge 221*a* of the finished surface 221 of countertop component 200, the molding component 300 and the countertop component 200 are firmly and tightly wedged together. Despite the tightness of this clamping action, as long as the glue is wet, the molding component 300 can still be adjusted vertically up or down to ensure proper alignment of top edges 31*a* and 221*a* at all points along the countertop assembly. The beads of glue applied in groove 36 and to tongue edge 38 of molding component 300 are forcibly distributed as countertop component 200 and molding component 300 are assembled thereby filling voids 42 and 43 with glue.

Because many varying and differing embodiments may be made using the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A countertop assembly comprising:

a countertop component having an unfinished edge, a wedged tongue member and a downwardly facing groove; and, a molding component having a upwardly facing groove and a tongue member and a flat back joining surface, wherein said upwardly facing groove slidably receives vertically therein said wedged tongue member to matingly interconnect said countertop component with said molding component, and, said downwardly facing groove slidably receives vertically therein said tongue member to simultaneously allow for vertical adjust and alignment of a top edge of said molding component with a top surface of said countertop component and to force said molding component against said countertop component unfinished edge.

2. The assembly of claim 1, wherein said top surface is made of laminate.

3. The assembly of claim 1, wherein said countertop portion further comprises:

said top surface being a top horizontal surface made of laminate; and, an underlay board made of particleboard wherein said underlay board has formed therein said wedged tongue member.

4. The assembly of claim 1, herein said wedged tongue member comprises a front exposed unfinished surface and a rearward surface wherein said rearward surface is slanted forwardly by a predetermined angle to taper a width of said wedged tongue member.

5. The assembly of claim 4, wherein said predetermined angle is approximately 4°.

6. The molding of claim 1, wherein said tongue member of said molding component extends upward slightly less than half the height of said flat back joining surface.

7. The molding of claim 6, wherein a depth of said upwardly facing groove is slightly greater than one half of a front exposed sidewall thickness of said countertop component and a width of said upwardly facing groove is substantially equal to a width of said wedged tongue member of said countertop component.

8. The assembly of claim 1, wherein said molding component has a generally J-shaped profile, said molding component comprises:

said flat back joining surface that extends down from said top edge thereof for a distance that is greater than the total thickness of the countertop component; and, an L configuration extending rearward from the lowest point on the flat back joining surface and then upward creating said tongue member having its face parallel to said flat back joining surface and said upwardly facing groove created between the front face of the upward facing tongue and the face of the flat back joining surface.

9. A method of assembling a countertop assembly having a countertop component including a top surface and a wedged tongue member and a downwardly facing groove and a molding component having a top edge, a tongue and a upwardly facing groove, said method comprising the steps of:

a) applying glue in said upwardly facing groove and said downwardly facing groove;

b) after the step of a), vertically sliding in said downwardly facing groove said tongue member of said molding component and simultaneously, vertically sliding in said upwardly facing groove said wedged tongue member of said countertop component; and, c) after the step of b) aligning and adjusting said top edge of said molding component with said top surface of said countertop component by vertically moving upward or downward slidably said upwardly facing groove along said wedged tongue member and said downwardly facing groove along said tongue member.

10. The method of claim 9, wherein the step of b) further includes wedging said wedged tongue member in said upwardly facing groove to clamp said wedged tongue member in said upwardly facing groove.

* * * * *